United States Patent [19]

Jordan et al.

[11] 4,102,365

[45] Jul. 25, 1978

[54] FILLING MEMBER FOR A COUNTERPRESSURE FILLING MACHINE

[75] Inventors: Heinrich Jordan, Dortmund; Siegmar Sindermann, Kamen-Heeren, both of Germany

[73] Assignee: Holstein & Kappert Aktiengesellschaft, Dortmund, Germany

[21] Appl. No.: 744,463

[22] Filed: Nov. 24, 1976

[30] Foreign Application Priority Data

Nov. 26, 1975 [DE] Fed. Rep. of Germany ..... 2552956

[51] Int. Cl.[2] ..... B67C 3/06

[52] U.S. Cl. ..... 141/39; 141/302; 141/372

[58] Field of Search ..... 141/39, 40, 286, 291–296, 141/301, 302, 310, 392, 46, 57, 369–372

[56] References Cited

U.S. PATENT DOCUMENTS

| | | | |
|---|---|---|---|
| 2,788,029 | 4/1959 | Solie | 141/294 X |
| 3,604,480 | 9/1971 | Reichert | 141/39 |

*Primary Examiner*—Richard E. Aegerter
*Assistant Examiner*—Frederick R. Schmidt
*Attorney, Agent, or Firm*—Toren, McGeady and Stanger

[57] ABSTRACT

In a counterpressure filling machine for filling a liquid in bottles or the like, the filling member is provided without a feed pipe. The filling member includes a valve housing with a centering bell mounted on its lower end. A gas pipe laterally enclosed by a filling sleeve is positioned within and extends downwardly through the housing and the centering bell. The gas pipe is a fixed member and the filling sleeve is axially displaceable relative to it between an open position and a closed position. In the closed position the lower end of the filling sleeve bears against a sealing seat on a repelling shield located at the lower end of the gas pipe.

5 Claims, 1 Drawing Figure

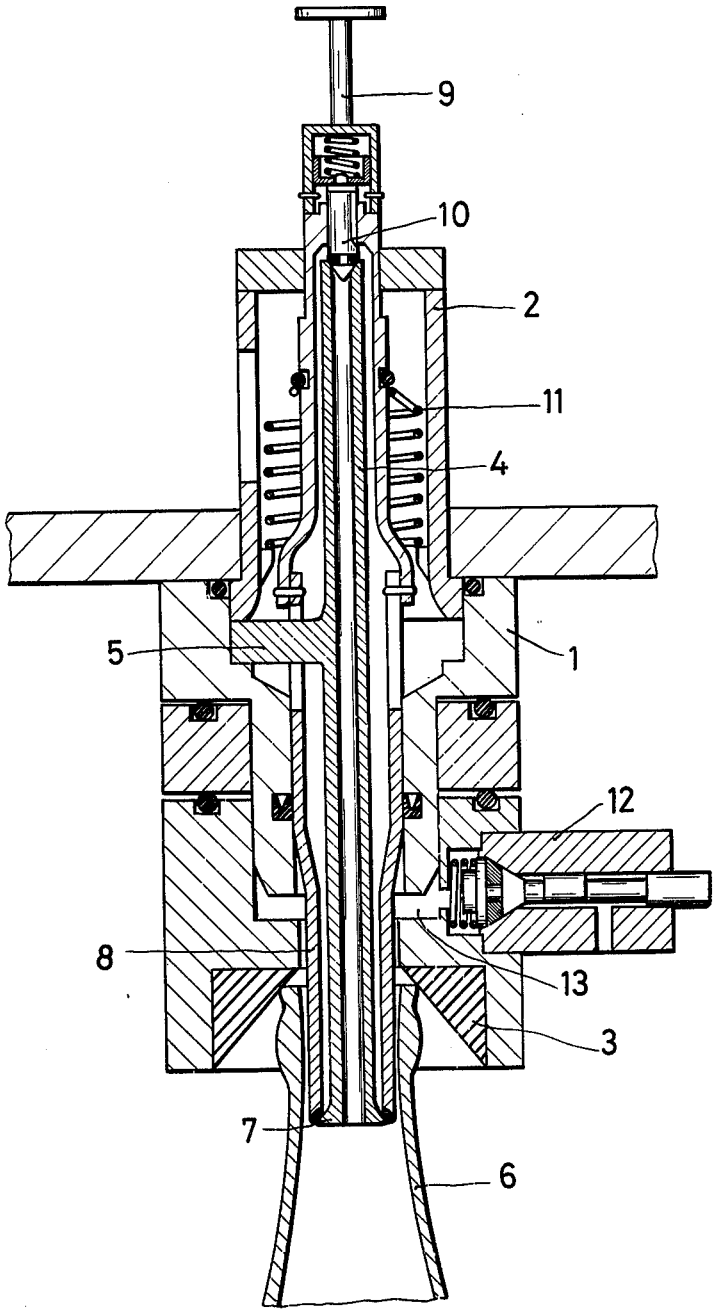
9
10
2
11
4
5
1
12
8
13
3
7
6

FILLING MEMBER FOR A COUNTERPRESSURE FILLING MACHINE

SUMMARY OF THE INVENTION

The present invention is directed to a filling member without any feedpipe for a counterpressure filling machine which supplies liquid into containers, such as bottles, cans and the like, and, more particularly, it is directed to a filling member including a valve housing, a gas pipe with a valve positioned concentrically within and passing downwardly through the valve housing, and a centering bell mounted on the lower end of the valve housing and movable in the vertical direction.

Such filling members are preferably used for introducing carbonated beverages into bottles and a large number of them are arranged one next to the other about the circular tank of a filling machine. The bottles or containers to be filled are supplied to vertically movable stand plates for movement into the loading positions and they are pressed against a centering bell which in turn bears against a centering stub on the filling sheet. With the container in position to be filled, it is pressurized by opening a gas valve. The pressure introduced into the container corresponds to the gas pressure within the filling tank. When pressure equalization is established between the containers and the filling tank, a liquid valve opens automatically and the liquid flows from the tank into the container through a liquid outlet along a gas pipe, which pipe has a repelling shield. Gas displaced by the liquid flowing into the container is returned into the gas space above the liquid within the filling tank passing through a gas return pipe which is followed by a gas duct in the valve stem.

As soon as the liquid in the container reaches the lower outlet opening of the gas pipe, further flow of the gas to the gas space is impossible and, accordingly, the flow of the liquid is stopped. With the termination of the filling operation, the liquid valve is closed, and a relief line opening into the ambient atmosphere about the filling machine is briefly opened by a relief valve. In known filling valves with an annular discharge duct formed below the closing body by the gas return pipe and an outlet sleeve, the disadvantage exists that in this duct, after completion of the filling operation, a certain amount of liquid remains which can be removed only with considerable difficulty. The residual quantity of the liquid results in an additional undefinable outflow of the liquid. Further, during the pressurization of the container, a portion of the additional liquid may flow through the relief valve to the outside leading to undesirable losses of the liquid or to an inaccurately filled amount in the containers.

The present invention is directed to the problem of preventing any additional flow of the liquid into the containers after the desired filling level has been attained during the filling operation and also to avoid any loss of such excess amounts during the depressurization process.

In accordance with the present invention, the gas pipe is held in a fixed position in the filling member and its end opening into the container to be filled is provided with a repelling shield which also acts as a sealing seat. A filling sleeve laterally encircling the gas pipe is movable to its open position under spring pressure and in the closed position it bears against the sealing seat on the end of the gas pipe. At its upper end, the gas pipe is equipped with a gas valve for passing the gas to the container and then for returning it to the filling tank. In addition, a centering bell laterally surrounds the outlet end of the filling sleeve and is provided with a relief valve which opens to the ambient atmosphere about the filling member.

In one embodiment of the invention, the centering bell is guided on a guide surface of the valve housing and the centering bell in combination with the valve housing and the outer surface of the filling sleeve, forms a gas space located above the filling level within the container. The filling sleeve has a larger diameter part located within the valve housing above that portion of the sleeve through which the liquid flows into the container. The particular advantage of the filling member consists in that, after completion of the filling operation, no further liquid can flow into the container and the space above the filling level outside the filling sleeve has a generally higher gas concentration. Therefore, during the depressurization process, the space about the filling sleeve is merely equalized with the surrounding ambient atmosphere and the space is always free of liquid. As a result, both liquid losses and imprecise filling levels are avoided. By providing the filling sleeve with a larger diameter above the outlet opening as compared to the diameter at the outlet opening, a differential pressure in the closing direction is effected due to the positive pressure existing within the filling tank. This differential pressure feature affords automatic closing of the valve.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

BRIEF DESCRIPTION OF THE DRAWING

The drawing is a vertical cross sectional view of the portion of a filling member embodying the present invention.

DETAILED DESCRIPTION OF THE INVENTION

As shown in the drawing, the filling member consists of a valve housing 1 defining a vertically extending passageway, a top mounted 2 on and extending upwardly from the valve housing, and a centering bell 3 vertically displaceably mounted on the lower end of the valve housing. Extending vertically through the passageway within the valve housing, a number of arms 5 are secured to and extend radially outwardly from the gas pipe into supporting contact with the valve housing 1. The arms, extending radially outwardly from the gas pipe, have a star shaped configuration.

At its lower end directed into the neck of a bottle 6, the gas pipe 4 has a repelling shield 7. Repelling shield 7 also serves as a sealing seat for a filling sleeve 8 which concentrically encloses the gas pipe so that an annular passageway is provided between the sleeve and the pipe. While the gas pipe 4 is fixed in position, the filling sleeve 8 is movable upwardly and downwardly in the axial direction of the pipe. A device 9 located on the top 2 of the filling member moves the filling sleeve 8 into the closed position, as shown in the drawing, with its lower end bearing against the sealing seat provided by the repelling shield 7. The device 9 also serves to actuate gas valve 10 located in the upper end of the gas pipe 4. The lower portion of the filling sleeve 8 passing through the centering bell 3 has a smaller diameter than the immediately adjacent upper portion located within the valve housing 1. The lower portion of the sleeve is spaced radially inwardly from the centering bell, however, the upper portion, having the increased diameter, has its outer surface in contact with the valve housing. The increased diameter of the filling sleeve 8 which is guided within the valve housing 1 affords an additional closing force on the filling sleeve which implements its automatic closing. When pressure equalization takes place, that is the pressure within the bottle or container 6 and the annular tank of the filling machine is the same, the filling sleeve is lifted off the sealing seat on the repelling shield 7 by the force of a spring 11 laterally encircling the upper end of the filling sleeve. As can be seen in the drawing, the spring 11 is helically coiled about the filling sleeve and is supported at its lower end on the top 2 and bears at its upper end against the filling sleeve 8.

The centering bell or tulip 3 is equipped with a relief valve 12 which opens to the ambient atmosphere surrounding the filling member. Alternatively, the relief valve 12 can be disposed in the valve housing and connected with the gas space via appropriate bores. During the filling operation, the centering bell 3 rests against parts of the valve housing 1 and forms in combination with the valve housing and the outer surface of the filling sleeve 8 a unitary space 13 which is pressurized when the gas valve 10 is opened. As soon as pressure equalization is achieved between the annular tank of the filling machine and the interior of the bottle or container 6, the liquid valve is opened by lifting the filling sleeve 8 upwardly by means of the spring 11. Filling of the bottle continues until the outlet opening from the lower end of the gas pipe 4 is closed by the steadily rising liquid level. With the gas pipe opening closed, the escape of gas from the bottle 6 is prevented and further flow of the liquid is halted. Simultaneously, the liquid valve provided by the filling sleeve is closed mechanically by the actuation of the device 9 and at the same time the gas valve is closed. With the opening of the relief valve 12, pressure equalization occurs and the space 13 is depressurized and the liquid present in the gas pipe 4 is forced back into the bottle through the gas cushion present in the upper portion of the pipe below the closed gas valve. Because of the design of the valve, there is no problem of the liquid flowing out of the container.

While specific embodiments of the invention have been shown and described in detail to illustrate the application of the inventive principles, it will be understood that the invention may be embodied otherwise without departing from such principles.

What is claimed is:

1. A filling member without a feed pipe for a counterpressure filling machine for filling a liquid into containers, such as bottles, cans and the like, including a valve housing having an upper end and a lower end and forming a vertically extending passage opening from the lower end thereof, a top closure for the upper end of said valve housing, a gas pipe extending vertically and concentrically through the passage in said valve housing, said gas pipe having an outlet opening at the lower end thereof supplying a pressurized gas into a container and a gas valve located within said gas pipe above the outlet opening therefrom for controlling flow of the pressurized gas to the container, means for opening said gas valve to initiate the flow of gas into the container, a centering bell mounted on the lower end of said housing and laterally enclosing the lower end of said gas pipe, wherein the improvement comprises that said gas pipe is fixed to said valve housing, a repelling shield formed on the lower end of said gas pipe laterally surrounding the outlet opening therefrom, said repelling shield forming a sealing seat, the lower end of said valve housing forming a guide surface, said centering bell disposed in contact with the guide surface of said valve housing and extending downwardly therefrom for movement thereon in the axial direction of said gas pipe when contacted by the container to be filled, a vertically extending filling sleeve concentrically disposed about said gas pipe and forming an annular flow passage therebetween, said filling sleeve having a lower outlet end for filling liquid into the container positioned by said centering bell, said filling sleeve being vertically displaceable between an upper open position for flowing liquid into the container and a lower normally closed position with the outlet end of said filling sleeve disposed in sealing engagement with the sealing seat on said repelling shield, spring means supported by said valve housing for biasing said filling sleeve into the open position when pressure equalization occurs between the container and said pressurized gas, said gas valve located in the upper part of said gas pipe, said centering bell laterally enclosing said filling sleeve, said centering bell in combination with the lower end of said valve housing and the outer surface of said filling sleeve forming a gas space and a relief valve connected to said centering bell with said relief valve opening to said gas space and having an open position and a closed position and in the open position connecting the gas space to the ambient atmosphere about the filling member means for opening said relief valve upon completion of container filling.

2. A filling member, as set forth in claim 1, wherein said filling sleeve having a lower part terminating in said outlet end and extending downwardly from said valve housing and an upper part located within said valve housing, said upper part and lower part being coaxial and said upper part having a larger inside diameter than said lower part.

3. A filling member, as set forth in claim 2, wherein said upper part of said filling sleeve being disposed in closely fitting contact with said valve housing and said lower part extending through said centering bell and being spaced radially inwardly from said centering bell forming a passage in communication with said gas space defined by said centering bell, the lower end of said valve housing and the outer surface of said filling sleeve.

4. A filling member, as set forth in claim 3, wherein said gas pipe having radially outwardly extending arms supporting said gas pipe on said housing, said filling sleeve having apertures in the vertical range of said arms with said arms extending outwardly through said apertures.

5. A filling member, as set forth in claim 4, wherein said valve housing having a top portion extending upwardly therefrom above the location of said arms on said gas pipe, and said spring means comprising a vertically extending helical spring laterally encircling said filling sleeve within said top portion above the location of said upper part of said filling sleeve in contact with said valve housing, and said spring supported at the lower end thereof on said top portion and at the upper end thereof bearing against said filling sleeve.

* * * * *